US007261625B2

(12) United States Patent
Hishiki

(10) Patent No.: US 7,261,625 B2
(45) Date of Patent: Aug. 28, 2007

(54) POLISHING PAD

(75) Inventor: Seigo Hishiki, Nagoya (JP)

(73) Assignees: Inoac Corporation, Aichi (JP); Rogers Inoac Corporation, Tokyo (JP)

( * ) Notice: Subject to any disclaimer, the term of this patent is extended or adjusted under 35 U.S.C. 154(b) by 105 days.

(21) Appl. No.: 11/050,722

(22) Filed: Feb. 7, 2005

(65) Prior Publication Data

US 2006/0178099 A1 Aug. 10, 2006

(51) Int. Cl.
*B24D 17/00* (2006.01)

(52) U.S. Cl. ..... 451/526

(58) Field of Classification Search ..... 451/526, 451/521, 527, 530, 533, 534, 537, 528, 529, 451/532

See application file for complete search history.

(56) References Cited

U.S. PATENT DOCUMENTS 6,358,130 B1 3/2002 Freeman et al.
6,361,414 B1 3/2002 Ravkin et al.
6,454,634 B1 9/2002 James et al.
6,544,107 B2 * 4/2003 Misra et al. ..... 451/41
6,582,283 B2 6/2003 James et al.
2002/0115385 A1 * 8/2002 Misra et al. ..... 451/41
2005/0189235 A1 * 9/2005 Emami et al. ..... 205/662
2005/0221723 A1 * 10/2005 Duboust et al. ..... 451/41

* cited by examiner

*Primary Examiner*—Jacob K. Ackun, Jr.
(74) *Attorney, Agent, or Firm*—Sughrue Mion, PLLC

(57) ABSTRACT

A single-layered polishing pad suitable for chemical mechanical polishing (CMP) of semiconductor wafers, etc., which attains excellent step height reduction and in-plane uniformity and is integrally molded by reaction injection molding, is provided. The polishing pad is a polyurethane-based foam 12 having a desired shape, as obtained by molding a gas-dissolved raw material having an inert gas dissolved under pressure in a polyurethane-base resin raw material by a reaction injection molding method, and includes a polishing region 14 having a polishing surface 14*a* suitable for polishing semi-conductor materials, etc. and having a Shore D hardness in the range of from 40 to 80 and a stress reduction region 16 which is present in the side opposing to the polishing surface 14*a* and which, when provided with a stress adjusting portion 22 of a desired pattern, is set up so as to have an amount of deflection, as applied with a load of 0.05 MPa, of 10 μm or more.

5 Claims, 5 Drawing Sheets

POLISHING PAD

FIELD OF THE INVENTION

The present invention relates to a polishing pad and more particularly to a polishing pad having a polishing region and a stress reduction region integrally molded therewith, which can effectively polish an object to be polished having high requirements for precision and surface flatness, such as semi-conductor wafers, by chemical mechanical polishing (CMP).

BACKGROUND OF THE INVENTION

One of important technologies supporting the recent rapid technical progress is the development of equipment of information technology such as computers. It is not too much to say that the development of performance of the aforementioned information technology can be attained by the development of performance and/or integration of CPU (central processing unit) of information engineering equipment, i.e., ULSI (ultra large scale integrated) devices constituting CPU. As one of methods for drastically developing the performance and/or integration of ULSI devices, a method has been practiced which comprises developing the horizontal integration of ULSI, i.e., finely dividing elements, while developing the vertical integration of ULSI, i.e., multi level interconnection of ULSI.

The most important factor of the aforementioned multi level interconnection of ULSI is to secure the depth of focus (DOF) of optical lithography by which the wafer is exposed to light through a pattern for metal wirings such as interlayer dielectrics and metal wirings. In other words, it is required that the difference in height of concave and convex in the roughened surface be smaller than DOF of exposing light for patterning. To this end, leveling must be made with a high precision. In the process for forming a multi level interconnection, when there is a certain or higher difference in height of concave and convex in the interlayer dielectrics or metal wirings, it is made impossible to effect sufficient focusing or form a fine wiring structure.

The high precision leveling of a semi-conductor wafer can be difficultly attained by conventional SOG (spin on glass) or etching. As a substitute for these methods, there has been normally used super precision polishing such as CMP (chemical mechanical polishing). The leveling by CMP is carried out by using an abrasive (normally referred to as "slurry", which will be used hereinafter) having a particulate material such as silica and alumina, mixed and/or dispersed in an alkaline or acidic chemically-corrosive aqueous solution and an elastic polishing material (hereinafter referred to as "polishing pad") against the surface to be polished of an object to be leveled such as semi-conductor wafers.

Then, in order to facilitate the understanding of a role of each of sites in the polishing pad, the general behavior of polishing an object T to be polished by a polishing platen 60 using a polishing pad 50 which has hitherto been used will be described hereinafter by referring to FIGS. 8A, 8B and 8C. The polishing pad 50 is fixed onto the polishing platen 60 and provided for use (see FIG. 8A). The object T to be polished is held by a pressure head 62 disposed opposing to the polishing platen 60 (see FIG. 8B). By rotating and/or oscillating the object T to be polished, which is held by the pressure head 62, and pressing the polishing pad 50 which is fixed onto the polishing platen 60 and rotated at an arbitrary rate against the object T to be polished with a prescribed pressure while feeding a constant amount of a slurry from a slurry feed unit 64, the object T to be polished is polished (see FIG. 8C).

The polishing pad 50 which is used in such an embodiment is required to have (1) high local leveling properties against the object T to be polished (hereinafter referred to as "step height reduction") and (2) high uniform leveling in wafer scale (entire wafer) (hereinafter referred to as "in-plane uniformity"). With respect to the step height reduction which expresses the local leveling properties (1), basically, if the hardness (rigidity) of the polishing surface in the polishing pad 50 is high, the so-called "step height reduction" becomes good due to preferential polishing of the convex in concave and convex of the object to be polished. On the other hand, however, since follow-up properties to waviness and mild concave and convex (generally called "nanotopography") of the surface of the object to be polished are low, the in-plane uniformity is disordered. In contrast, since the in-plane uniformity (2) becomes good by bringing into contact with and/or polishing the waviness or warp of the surface of the object to be polished while applying a uniform load thereto, it is desired that the material of the polishing pad 50 is soft. That is, it was difficult to cope with both the step height reduction (1) and the in-plane uniformity (2).

In order to cope with both the step height reduction (1) and the in-plane uniformity (2), the polishing pad 50 was constructed such that a raw material having high hardness is used for the polishing surface which comes into contact with the surface of the object to be polished and that a raw material having low hardness, which enhances the follow-up properties to the object to be polished, is used in the side of the back surface of the polishing surface, namely, the side to be fixed onto the polishing platen 60. This has a so-called multilayered structure composed of a combination of two or more raw materials bonded to each other, such as a combination of a polishing layer 52 having high hardness on which a polishing surface is formed with a stress reduction layer 54 having low hardness as illustrated in FIG. 9.

The polishing pad 50 was generally provided for the actual polishing works in the following steps. That is, as illustrated in FIGS. 10A, 10B, 10C and 10D, (1) a first pressure-sensitive adhesive layer 56 composed of a substrate and a pressure-sensitive adhesive as in a double-sided pressure-sensitive adhesive tape is stuck on to the polishing platen 60 upon which the polishing works are carried out (see FIG. 10A); (2) the stress reduction layer 54 is stuck onto the pressure-sensitive adhesive layer 56 (see FIG. 10B); (3) a second pressure-sensitive adhesive layer 58 is stuck onto the stress reduction layer 54 (see FIG. 10C); and (4) the polishing layer 52 is ultimately stuck onto the second pressure-sensitive adhesive layer 58 (see FIG. 10D).

In order to attain the high in-plane uniformity (2), in sticking and/or fixing the resulting polishing pad 50 onto the polishing platen 60, it is required that the level in height on the surface of the polishing layer 52 is uniform and that an equivalent drag is outputted against a stress input such as a pressure in any portion of the surface of the polishing layer 52. However, when the pressure-sensitive adhesive layers 56 and 58, the polishing layer 52 and the stress reduction layer 54 are successively laminated (four times in this example) on the polishing platen 60, it is pointed out that the following problems are caused due to the thinness of the pressure-sensitive adhesive layers 56 and 58 and the difficulty in handling by adhesiveness.

That is, there are pointed out such problems that (1) it is difficult to uniformly stick the pressure-sensitive adhesive layer 56 or 58, or the level in height on the polishing surface does not become uniform because of the generation of air accumulation or non-uniformity of fine thickness generated due to a difference in stretching by the site of the pressure-sensitive adhesive layer 56 or 58; and that (2) the sticking of the pressure-sensitive adhesive layers 56 and 58, the stress reduction layer 54 and the polishing layer 52 is insufficient so that end portion is invaded by moisture or peels away during the polishing works. In the problem (1), the in-plane uniformity on the surface of the resulting object to be polished cannot be kept. With respect to the problem (2), the end portion in the polishing layer 52, etc. peels away or floats due to the invasion of moisture, whereby the profile control of an edge portion, etc. of a wafer as the object to be polished becomes difficult. The air accumulation is small in size, and after sticking of the polishing layer 52 and the stress reduction layer 54, it is covered by the respective layers 52 and 54. Accordingly, it cannot be observed from the outside, and the discovery is difficult (actually, the discovery of the air accumulation is judged only from the results regarding the polishing state on the surface of the object to be polished such as wafers). Also, since these problems cannot be surely avoided without skill of the sticking works, it is difficult to prevent such problems from occurring.

Further, it may be considered that the stress reduction layer 54 having high flexibility is stretched in the horizontal direction during sticking and/or fixing due to the contents of works. If a part of the stress reduction layer 54 is stretched in the horizontal direction, different flexibility is revealed depending upon the site of the stress reduction layer 54, resulting in making it impossible to attain sufficient in-plane uniformity.

Also, by integrating the polishing layer 52 with the pressure-sensitive adhesive layer 56 during producing the polishing layer 52 or by integrating the stress reduction layer 54 with the pressure-sensitive adhesive layer 58 during producing the stress reduction layer 54, it is possible to reduce the time of the lamination works on the polishing platen 60 into two times, thereby possibly reducing a probability of the generation of the aforementioned problems. Moreover, by employing a method in which in the production stage, not only the polishing layer 52 and the stress reduction layer 54 are laminated, but also a pressure-sensitive adhesive layer against the polishing platen 60 is laminated on the stress reduction layer 54 in advance, it may be possible to reduce a probability of the generation of the aforementioned problems, too. In this case, however, the lamination at the time of production is difficult, and the deterioration of the production yield leads to an increase of the production cost. Accordingly, this method could not be a fundamental dissolution method.

SUMMARY OF THE INVENTION

In the light of problems with polishing pads according to the related art, the invention has been proposed to solve fairly these problems. An aim of the invention is to provide a single-layered polishing pad having been integrally molded by reaction injection molding, which is suitable for chemical mechanical polishing (CMP) of a semi-conductor wafer, etc. and which can attain excellent step height reduction and in-plane uniformity.

In order to overcome the aforementioned problems and accomplish the required aim, the polishing pad according to the invention comprises a polyurethane-based foam in a desired shape having fine and uniform cells, which is obtained by using a gas-dissolved raw material comprising a mixture of a polyurethane or polyurea as a main raw material and various subsidiary raw materials and having an inert gas dissolved under pressure therein and molding the gas-dissolved raw material by a reaction injection molding method, wherein the polishing pad includes a polishing region having a polishing surface suitable for polishing semi-conductor materials, etc. and having a Shore D hardness (defined according to ASTM D2240) in the range of from 40 to 80, and preferably from 55 to 75; and a stress reduction region which is present in the side opposing to the polishing surface and which, when provided with a stress adjusting portion of a desired pattern, is set up so as to have an amount of deflection, as applied with a load of 0.05 MPa, of 10 μm or more, and preferably 15 μm or more.

DESCRIPTION OF THE REFERENCE NUMERALS AND SIGNS

12: Polyurethane-based foam
14: Polishing region
14*a*: Polishing surface
16: Stress reduction region
18: Cell
20: Discharge groove
22: Stress adjusting portion

DETAILED DESCRIPTION OF THE INVENTION

The polishing pad according to the invention will be further described hereinafter with reference to preferred embodiments. The inventor of this application has found that by molding a polyurethane-based raw material with or without a gas-dissolved raw material, which has an inert gas dissolved in the raw material by a reaction injection molding method, a polishing region having high hardness and a stress reduction region in which by forming a stress adjusting portion of a desired pattern, its hardness is set up smaller as an entire (macro) structure than that of the polishing region to attain a prescribed amount of deflection are integrally molded, thereby obtaining a polishing pad capable of having high step height reduction and high in-plane uniformity. With respect to the same members already described in the technologies of the related art with reference to FIGS. 8A, 8B and 8C, FIG. 9, and FIGS. 10A, 10B, 10C and 10D, the same symbols are given, and their detailed explanations are omitted.

Figure 1:
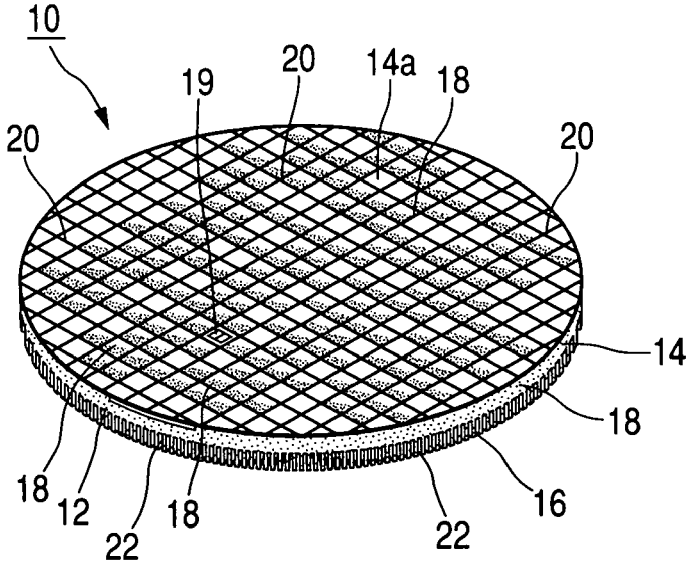
FIG. 1 is a schematic perspective view illustrating a polishing pad according to a preferred embodiment of the invention.

As illustrated in FIG. 1, a polishing pad 10 according to the present embodiment comprises a polyurethane foam 12 obtained by molding a polyurethane-based raw material into the circular sheet form by reaction injection molding. The polyurethane foam 12 is formed of a polishing region 14 having a polishing surface 14*a* for polishing an object to be polished for the purpose of attaining leveling and a stress reduction region 16 for revealing prescribed flexibility (cushioning properties) for the purpose of applying a uniform pressure against polishing by the polishing surface 14*a*. The polishing pad 10 is provided at a portion thereof with a window for end point detection of polishing, a so-called monitoring window 19, having translucency and extending along the entire length in the thickness direction of the pad 10 or a part thereof through which the condition of the polished surface of the object to be polished can be always confirmed during the use of the pad.

Figure 2:
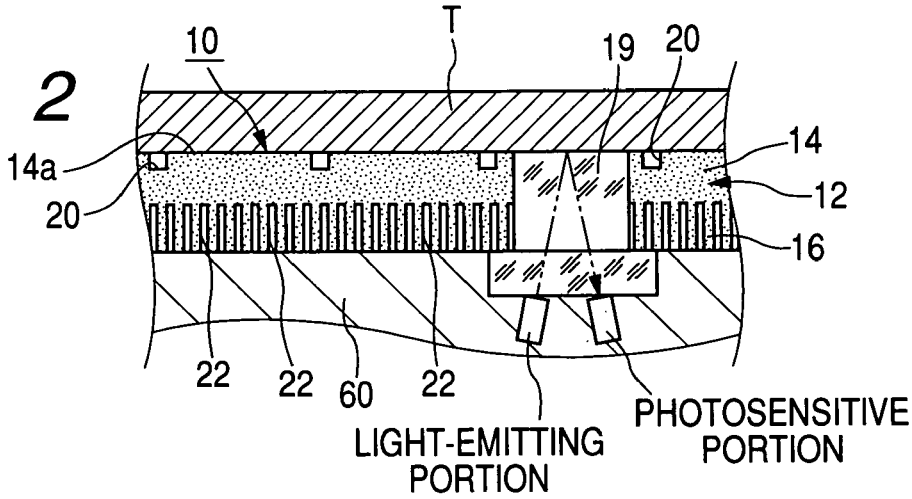
FIG. 2 is a schematic view illustrating how polishing is effected using a polishing pad provided with a window for the end point detection of polishing.

The monitoring window 19 is preferably made of a non-foamed resin or the like which is the same as that of the polyurethane-based foam 12. This is because when the monitoring window 19 is made of the same material as the polyurethane-based foam 12 constituting the polishing surface 14*a* of the polishing pad 10, the monitoring window 19 can fairly fit the polyurethane-based foam 12 formed by reaction injection molding, making it possible to prevent the monitoring window 19 from being separated from the polishing pad 10 during polishing. The polishing pad 10 provided with the monitoring window 19 can be provided with a polishing platen comprising a desired light-emitting portion and a photosensitive portion as illustrated in FIG. 2 to perform polishing while successively confirming how the polished surface of the object to be leveled is polished.

For the purpose of attaining the abovementioned step height reduction, the polishing region 14 is constituted so as to have hardness, bulk density and cell size of prescribed ranges. The polishing surface 14*a* in the polishing region 14 is provided with a discharge groove 20 in the desired shape such as a lattice form and a concentric circle form having a desired depth while taking into account good diffusibility of a slurry to be used in the polishing region 14 and discharge properties of polishing waste, a coagulated slurry, etc.

The material hardness of the polyurethane-based foam 12 constituting the polishing pad 10 is one of the important indexes with respect to the polishing performance, especially the step height reduction and largely affects the other in-plane uniformity. In the invention, a Shore D hardness is employed as the material hardness, and the Shore D hardness is set up in the range of from 40 to 80, and preferably from 55 to 75. In the case where the Shore D hardness is less than 40, the resulting polishing pad is too soft that it becomes fit onto the surface of concave and convex of the object to be polished such as wafers, whereby polishing of the convex cannot be positively effected. For example, the step height reduction within a prescribed margin of not more than 1 μm is not satisfied.

On the other hand, in the case where the Shore D hardness exceeds 80, the toughness of the polishing pad 10 is relatively lowered and becomes brittle. For this reason, during polishing, the polishing pad 10 per se is scraped off, and the scraped waste causes clogging of cells 18. As a result, the retention of the slurry into the cells 18 is lowered, whereby the polishing rate representing the speed of polishing of the object to be polished becomes unstable, and the polished surface is liable to cause scratching. Accordingly, the Shore D hardness at which the polishing pad does not cause scratching and has excellent step height reduction is preferably from 55 to 75.

In general, the larger the total hydroxyl value of polyol components, etc. (the sum of compounding ratios of hydroxyl values of the individual raw materials), the higher the Shore D hardness. This is because by selecting and/or filling a hard segment for forming the polyurethane-based foam 12 (an organic isocyanate, a chain extender or a crosslinking agent), rigidification of the polymer constituting the foam 12 proceeds. For example, such can be easily controlled by increasing an isocyanate index (a percentage represented by the hydroxyl group and amino group with respect to the isocyanate group). By using the polyurethane-based foam 12 having such physical properties, it is possible to obtain the polishing pad 10 having the polishing region 14 which is excellent in the step height reduction.

The bulk (apparent) density is an index which largely affects the hardness of the polishing pad 10 and the amount of deflection revealed by the stress reduction region 16 although it also affects the cell size. The bulk density also largely affects the polishing rate (a polishing amount of the object to be polished per unit time at which the polishing surface 14*a* polishes the object to be polished) which is one of indexes representing the leveling properties. Basically, the bulk density is set up in the range of from 0.6 g/cm$^3$ to 1.0 g/cm$^3$, and preferably from 0.7 g/cm$^3$ to 0.8 g/cm$^3$. In the case where the bulk density falls outside the range of from 0.6 g/cm$^3$ to 1.0 g/cm$^3$, it becomes difficult to set up the hardness at a desired value, or it becomes difficult to efficiently polish the object to be polished due to fluctuations of the ratio of fine cells occupying in the polishing surface 14*a*.

In general, in the case of obtaining a foam by reaction injection molding using a gas-dissolved mixed raw material having the inert gas dissolved therein, the bulk density can be easily adjusted by changing the injection pressure and injection time during injecting the mixed raw material into a reaction injection mold 38. The amount of the inert gas for dissolving the raw material therein in advance may be adjusted.

Figure 3:
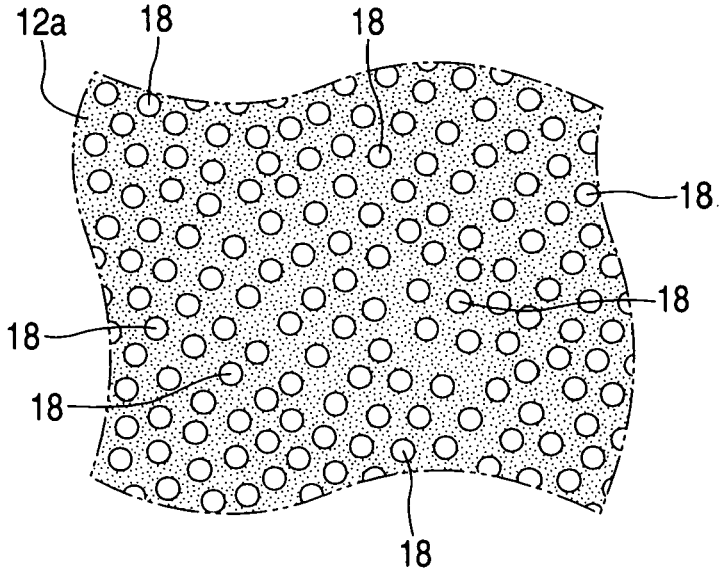
FIG. 3 is an enlarged plan view illustrating the polishing surface of a polishing pad according to an embodiment.

Explaining the polishing surface 14*a* in an enlarged scale, numerous cells 18 having substantially the same diameter developed by the inert gas released by the aforementioned action are dispersed entirely uniformly therein as illustrated in FIG. 3. The cell size of the cells 18 is affected by the molding conditions in the reaction injection molding method as described later, i.e., pressure in the reaction injection mold, gas saturation pressure (pressure in the raw material tank), the curing conditions (temperature and/or time), the gelation time, i.e., time between the point at which the raw material is injected and the point at which it is cured during the reaction injection molding, the bulk density, and the like.

The inner diameter of the cells 18, i.e., the cell size, decreases in inversed proportion to an increase in the pressure in the mold, etc. and increases in proportion to an increase in the gelation time under conditions under which the curing temperature becomes low, etc. The pressure in the mold and the curing temperature can be properly set up. The gelation time can be arbitrarily controlled by adjusting the reactivity of the raw material with a catalyst or the like. The cell size can be controlled also by the bulk density of the resulting foam as described previously. The cell size can be controlled also by raising the viscosity of the raw material. However, since it may be considered that the completion of mixing, the fluidity in the mold, etc. become worse, this method cannot be preferably used. If desired, by using a surfactant, it is also possible to lower the surface tension of air bubbles which form the cells and to control the cell size due to control of the coalescence and/or growth of the cells.

The average cell size is set up in the range of from 1 μm to 50 μm, and preferably from 15 μm to 30 μm. In particular, when the cell size is as small as not more than 30 μm, the cell depth of the polishing surface 14*a* is reduced, making it possible to decrease the amount of conditioning (dressing). This simplification of dressing inhibits the abrasion of the polishing pad 10, resulting in an effect for prolonging the life of the polishing pad 10.

When the average cell size is less than 1 μm, the resulting polishing pad 10 is comparatively easily subject to dull edge of the cross section of forming the cells 18 or clogging of cells with polishing waste or the like. Such a polishing pad cannot perform stable polishing and thus must be subjected to dressing more frequently. On the other hand, when the average cell size exceeds 50 μm, the resulting polishing pad tends to be subject to dispersion of the cell size. Such a polishing pad 10 can retain a slurry less uniformly and thus cannot exhibit a stabilized quality. Further, when the dispersion of the cell size is remarkable, the resulting polishing pad 10 is subject to partial density difference that can possibly impede the polishing conditions.

The discharge groove 20 is one for efficiently discharging the slurry to be used for polishing and so-called polishing waste produced from the object to be polished during polishing out of the system. The optimum value of the depth of the discharge groove 20 varies depending upon the material of the object to be polished and polishing conditions such as the slurry flow rate to be determined but is generally set up in the range of from about 0.1 mm to 0.5 mm. As the shape of the pattern of the discharge groove 20 to be formed, likewise the polishing pad 10, a concentric circle, spiral or radiation form or a plurality of holes having a desired diameter may be employed besides the aforementioned lattice form. However, it should not be construed that the invention is limited thereto. The discharge groove 20 may be in any shape so far as the aforementioned polishing waste can be efficiently discharged by movements such as rotation accompanying the polishing of the polishing pad 10 during polishing.

The stress reduction region 16 is a region for imparting so-called cushioning properties for the purpose of enhancing the in-plane uniformity of the object to be polished during using the polishing pad 10 while pressing it against the object to be polished. The stress reduction region 16 is provided with a stress adjusting portion 22 which communicates with the stress reduction region 16 over the full length in the thickness direction and is formed with a desired pattern. The stress adjusting portion 22 plays a role for revealing the stress reduction (cushioning) properties by rendering the stress reduction region 16 in the state where the bulk (apparent) density is lowered, i.e., the whole structure is coarse. In the invention, the stress reduction is expressed in terms of the amount of deflection when applied with a prescribed load, and the load is set up at 0.05 MPa, a value of which is approximately equal to a load applied during the actual polishing. In the invention, the reason why the "amount of deflection" is employed as an item for evaluating the stress reduction of the polishing pad 10, i.e., the cushioning properties, resides in that matter that when the structure is made coarse, thereby revealing the cushioning properties as a whole, the physical properties of the material per se such as the aforementioned hardness is no longer employable.

In thinking the amount of deflection in the stress reduction region 16, the following should be considered. That is, two factors for determining the amount of deflection including the density which determines the hardness and the thickness of the stress reduction region 16 which determines the amount of deflection by the density should be considered. In the case of the polishing pad 10 according to the invention, the density as referred to herein is a value to be determined by its hardness and structure; and the thickness is determined by specifications of the polishing platen 60, etc. for fixing and/or using the polishing pad 10 or conditions for attaining preferred polishing properties which have been accumulated from the past, etc. The upper limit of the thickness of the stress reduction region 16 is considered to be about 2 mm.

The reason why the value "2 mm" is introduced is as follows. That is, the total thickness of the polishing pad 10 as a whole is set up at from about 2 to 3 mm in view of the specifications of the polishing platen 60 or conditions for attaining preferred polishing properties, etc. The lower limit of the thickness of the polishing region 14 is set up at about 1.0 mm in view of various conditions such as the depth of the discharge groove 20 to be provided. From these numerical values, the upper limit of the stress polishing region 16 is set up at [3.0 mm (total thickness of the polishing pad 10)−1.0 mm (lower limit of the thickness of the polishing region 14)=about 2.0 mm].

In the stress reduction region 16 according to the invention, the amount of deflection when applied with a load of 0.05 MPa is required to be 10 μm or more and is preferably 15 μm or more. Taking into account the aforementioned upper limit of the thickness of 2 mm, in order to attain this amount of deflection, there may be enumerated a method in which the stress reduction region 16 is made to have a bulk density of not more than 0.35 g/cm$^3$ by forming the stress adjusting portion 22. When the bulk density exceeds 0.35 g/cm$^3$, it becomes difficult to attain the aforementioned amount of deflection, whereby the in-plane uniformity of the polishing pad 10 becomes worse. In the case where the bulk density is not more than 0.15 g/cm$^3$, the contact area with the polishing platen 60 is too low so that a problem is caused in stickiness. Therefore, an attention must be paid.

0.05 MPa is a representative value of the load pressure to be generally used in polishing pad devices.

By setting up the amount of deflection at 10 μm or more, and preferably 15 μm or more, it is possible to obtain a pad having excellent buffer properties during polishing. In a wafer obtained by polishing with the pad of the invention, it becomes possible to undergo polishing with good in-plane uniformity and optimum polishing rate.

The bulk density of the stress reduction region 16 is adjusted by the pattern and shape of the stress adjusting portion 22 to be formed, namely, its width, depth and pitch.

In order to obtain a uniform cushioning effect over the whole surface of the stress reduction region 16, namely in order that the stress reduction region 16 may be uniformly deflected, i.e., the bulk density may not vary depending upon the site of the stress reduction region 16, the stress adjusting portion 22 is formed in a uniform depth such that it is flatly and uniformly distributed. As the shape of the pattern, a concentric circle, spiral or radiation form while making the center of the polishing pad 10 as a base point, or a plurality of holes having a desired diameter may be suitably employed in addition to the lattice form.

As described, previously, the stress reduction-region 16 is integrally molded together with the polishing region 14, and no boundary to explicitly distinguish the both layers 14 and 16 from each other is present. However, it is possible to consider the portion in which the stress adjusting portion 22 is formed to be the stress reduction region 16 because this portion can be said to be a portion in which the bulk density is reduced and the amount of deflection of a certain value or more can be revealed.

Figure 5:
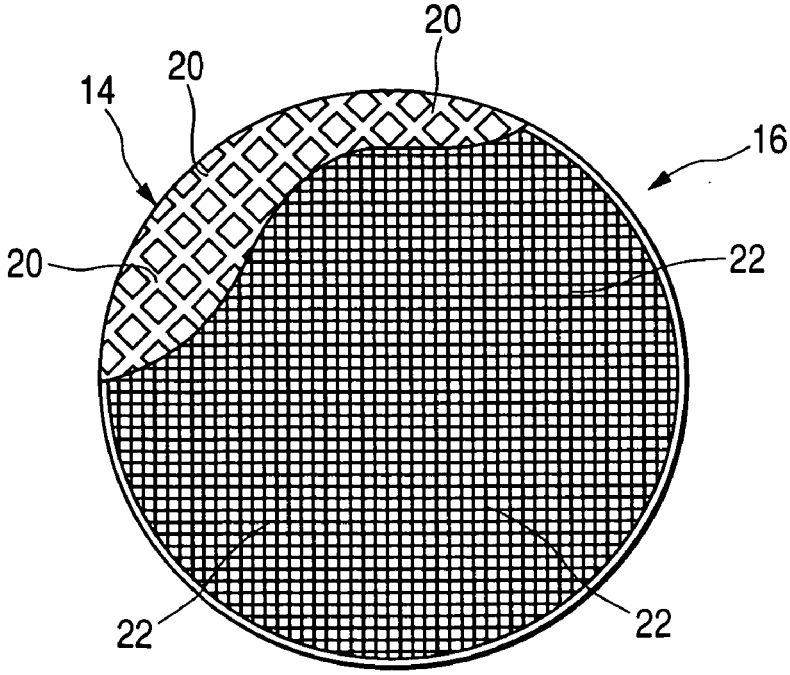
FIG. 5 is a schematic plan view illustrating a notch of one example of the case where a stress adjusting portion does not communicate with an external peripheral surface of a stress reduction region.

The relationship between the discharge groove 20 to be formed in the polishing region 14 and the stress adjusting portion 22 is shown in FIG. 5. FIG. 5 shows the structure in which the discharge groove 20 does not communicate with the stress adjusting portion 22.

Taking into account the state of the slurry to be used during polishing, the ratio of an opening portion 24 is desirably not more than 30 based on 100 of the surface area of the polishing pad 10. When the ratio exceeds this numerical value, the slurry which has flown into the discharge groove 20 of the upper polishing region 12 is not efficiently used for polishing and successively discharged out the polishing pad 10 from the lower stress adjusting portion 22 via the opening portion 24, i.e., a vertically opened three-dimensional groove. This situation can be prevented from occurring by making a communicating portion of the external periphery of the stress reduction region 16 of the stress adjusting portion 22 with the outside nothing or controlling it as illustrated in FIG. 5.

Figure 4:
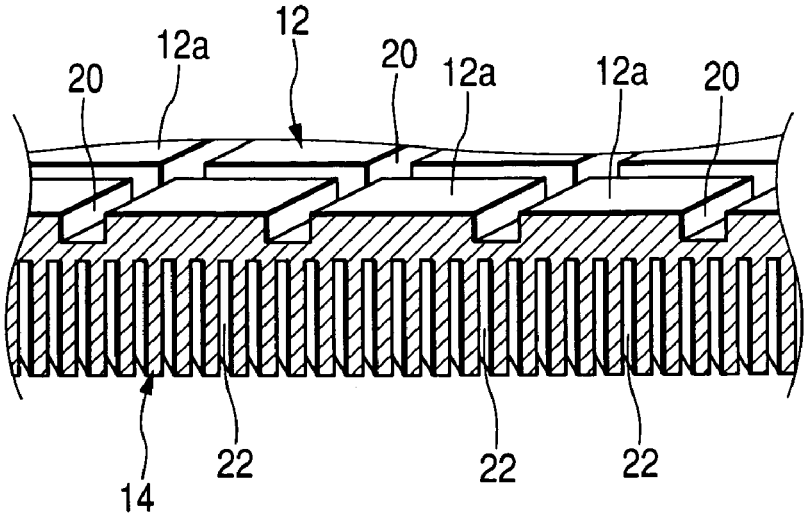
FIG. 4 is a schematic cross-sectional view illustrating a polishing pad in which a discharge groove does not communicate with a stress adjusting portion.

As illustrated in FIG. 4, in the case of a structure in which the discharge groove 20 does not communicate with the stress adjusting portion 22, the slurry to be used during polishing does not penetrate into the polishing pad 10. Accordingly, since the slurry is present only in a gap between the object T to be polished and the polishing pad 10, in the case where the pressure of the polishing pad 10 against the object to be polished is made identical during polishing, it is possible to make the amount of the slurry to be used small. Further, the pressure upon which the deflection of the stress reduction region 16 is generated can be dispersed over the whole of the stress reduction region 16 by a portion present between the discharge groove 20 and the stress adjusting portion 22, and therefore, an effect for enhancing the in-plane uniformity can be expected, too.

Besides, as a measure for attaining the aforementioned amount of deflection without forming the stress adjusting portion 22, there may be considered a method in which the thickness of the polishing pad 10 per se is made so as to have a large size. The thickness of the polishing pad 10 to be generally used was determined to be not more than about 2.5 mm from the standpoints of the relationship with a polishing device accompanied with the polishing platen 60 and costs of the raw materials to be used. However, in the case where the hardness of the polishing pad 10 to be used in the invention is set up in the range of from 40 to 80, and preferably from 55 to 75 in terms of the Shore D hardness, it is possible to attain the aforementioned amount of deflection so far as the thickness of the pad 10 is 4.0 mm or more. However, with respect to the aforementioned thickness, there is fear of adverse influences against the rotation movement, etc. during polishing due to increases in costs of the raw materials and weight, and the aforementioned contents must be taken into consideration. Therefore, the actual use is accompanied with difficulty.

<Embodiments of Production Device and Production Process>

In order to facilitate the understanding of the aforementioned description of the production device by a reaction injection molding method for producing the polishing pad 10, the outlines of a device for producing a polishing pad 10 made of a polyurethane-based foam and reaction injection molding method will be described hereinafter.

Figure 6:
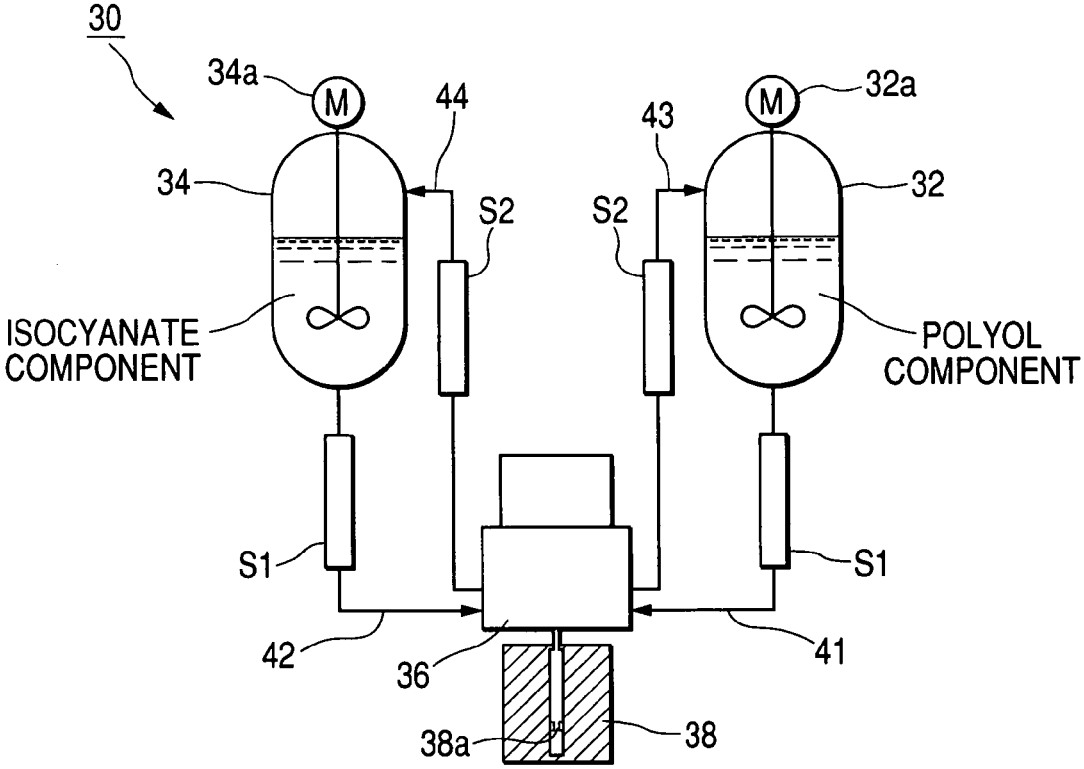
FIG. 6 is a schematic view illustrating one example of a reaction injection molding device for carrying out a reaction injection molding method.

As shown in FIG. 6, a production device 30 is basically constructed of a first raw material tank 32 for storing a polyol and/or polyamine component, a second raw material 34 for storing an isocyanate component, a mixing head 36, and a reaction injection mold 38. The first raw material tank 32 and the second raw material tank 34 are connected to the mixing head 36 with feed pipes 41 and 42, respectively. The first and second raw material tanks 32 and 34 are provided with mixers 32*a* and 34*a*, respectively, so that the various raw materials stored in the raw material tanks 32 and 34 are stirred under control. The path from the first and second raw material tanks 32 and 34 to the mixing head 36 are each provided with equipment S1 comprising a strainer, a feed pump such as a metering pump, a high pressure filter, etc.

The mixing head 36 and the raw material tanks 32 and 34 are also connected to each other with return pipes 43 and 44 through which the various raw materials which have not been provided for injection are returned to the raw material tanks 32 and 34, respectively. The polyol component and the isocyanate component are cycled from the first and second raw material tanks 32 and 34 back to the first and second raw material tanks 32 and 34 through the mixing head 36, respectively, at a constant pressure of from about 0.1 MPa to 50 MPa. The return pipes 43 and 44 from the mixing head 36 to the first and second raw material tanks 32 and 34 are respectively provided with equipment S2 such as a heat exchanger as necessary.

Explaining the reaction injection molding method with reference to a step of producing the polyurethane-based foam 12 by the production device 30, the interiors of the first and second raw material tanks 32 and 34 are each compressed by an inert gas such as air and a dry nitrogen gas to a constant pressure in the range of from 0.1 MPa to 50 MPa, where the feed pump is not out of order. The various raw materials in the raw material tanks 32 and 34 are stirred by means of the mixers 32*a* and 34*a*, respectively at a constant rate so that they are kept at a prescribed temperature. The upper inner portions of the raw material tanks 32 and 34 are each covered by an inert gas. In this arrangement, the various raw materials undergo convection with stirring by the mixers 32*a* and 34*a*, and as a result, a prescribed amount of the inert gas is dissolved in the raw materials by the action of bubbling. In practice, it is not necessary that the inert gas be dissolved in both the polyol component and the isocyanate component. A prescribed subsidiary raw material such as a catalyst, a chain extender and/or a crosslinking agent may be added and/or mixed in the polyol component having high chemical stability in admixture. The inert gas may be then dissolved in the mixture to produce a gas-dissolved raw material.

The term "polyurethane" of the polyurethane-based foam 12 as referred to in the invention is meant to indicate the general term of a polymer having a urethane (urea) bond produced by the polyaddition reaction of an organic isocyanate with an active hydrogen compound. The polyurethane which has been actually used is synthesized by properly adding the aforementioned subsidiary raw materials to a polyisocyanate and a polyol as a base. The bases and the subsidiary raw materials may be properly combined to obtain polymers having various physical properties. As the inert gas, there may be used carbon dioxide which exhibits a high diffusion coefficient. Besides, there may be used readily available inert gases which do not affect the polyaddition reaction for synthesis of polyurethane, such as nitrogen, argon, and dry air (normally not used because if highly humid air is used, its moisture reacts with the isocyanate to produce a gas that affects the foaming state of the foam).

As the polyol component, there may be used polyether polyols, polyester polyols, polycarbonate polyols, and polydiene-based polyols. These polyols may be used singly or in combinations of two or more thereof. As the polyamine component, there is preferably used any material obtained by substituting the hydroxyl group in the polyol component by an amino group.

As the isocyanate component, there may be used toluene diisocyanate (TDI), a TDI prepolymer, methylene diphenyl diisocyanate (MDI), crude MDI, polymeric MDI, urethodione-modified MDI, and carbodiimide-modified MDI. These isocyanate components may be used in the form of a prepolymer. The materials to be used herein are not limited to the various materials described herein, but other known materials can be used.

Subsequently, the aforementioned two raw materials are mixed in collision in the mixing head 36 and then injected into a reaction injection mold 38 set up at a prescribed mold inner pressure and having a cavity 38*a* having a shape conforming the external profile of the polishing pad 10 to be immediately produced for a predetermined period of time while controlling the injection pressure. In this manner, the reaction and/or curing of the various raw materials thus mixed proceeds. At the same time, the inert gas dissolved in the mixture is released. The resulting expansion of the inert gas causes the mixture to be foamed to form a foam having a shape conforming the external profile of the cavity 38*a*.

Accordingly, with respect to the monitoring window 19, it is possible to correspond thereto by previously disposing a corresponding member in position in the reaction injection mold 38. The discharge groove 20 and/or the stress adjusting portion 22 can be easily formed with cavity transcription by reaction injection molding of a corresponding shape in the cavity 38*a*. Besides, after preparing polishing pad 10 merely in the columnar form having a desired thickness, the discharge groove 20 and/or the stress adjusting proportion 22 may be formed by mechanical grinding using a cutter, etc. or post processing using laser, etc.

Foaming can be effected by injecting the inert gas with the gas saturation pressure into the reaction injection mold 38 under conditions of a lower or higher pressure so that the resulting action of pressure change such as reduction of pressure causes the inert gas to be released into the mixture of raw materials. During this procedure, the release of the inert gas occurs at the same probability regardless of the site of occurrence so far as it occurs in the mixture of raw materials of the same equilibrium system having the inert gas dissolved therein. Further, the expansion of the inert gas thus released occurs at substantially the same rate everywhere in the system. Therefore, the inert gas can be released without causing any non-uniformity from site to site, i.e., uniformly and at random. Further, cells having substantially the same size can be formed. Moreover, since the release of the inert gas occurs in the same equilibrium system, the resulting cells have a substantially spherical form that exerts an effect of making the pressure of the foam uniform.

The expansion of the cells is essentially determined by the rate at which the mixture of raw materials undergoes reaction and/or curing. This demonstrates that the reaction rate can be controlled to control the degree of expansion of the cells 18, i.e., cell size. When the aforementioned reaction injection molding method is used, the two phase raw materials which have been mixed can be immediately injected into the mold 38 to undergo reaction and/or curing at a high rate. Thus, raw material compositions which cannot be molded by other molding methods can be used herein. Moreover, a foam having a smaller cell size can be produced.

The aforementioned reaction injection molding method is a production process which has hitherto been used as a molding method for automobile interior and exterior parts. As the foaming method, there may be properly used (1) a so-called physical foaming method which comprises vaporizing a low-temperature volatilizing liquid such as low molecular weight chlorofluorohydrocarbons, methylene chloride and pentane from an uncured liquid reaction mixture to form cells; (2) a so-called chemical foaming method which comprises adding water as a foaming agent to a polyol component, mixing the mixture with an isocyanate component, and then allowing the reaction with the isocyanate so that carbon dioxide is liberated as a foaming gas to form cells; and (3) a so-called mechanical foaming method which comprises blowing the inert gas into the reaction mixture or one of the two raw materials, and then shearing the material during stirring to form cells besides the aforementioned method involving the utilization of dissolution of inert gas. However, since these foaming methods can produce cells having a deteriorated uniformity in dispersibility or cell size, an attention should be paid in selecting these foaming methods.

In addition, as the production process of a foam having good uniformity in dispersibility or cell size of cells, there may be employed a so-called extraction method in which a prescribed soluble material is mixed and/or kneaded in the raw material to form a molding, and the soluble material is then extracted and/or removed, or a foaming method in which such a thought is combined with any of the aforementioned (1) to (3) methods. In this case, by controlling the particle size of the soluble material, it is possible to enhance the uniformity in cell size of the resulting foam. Also, by thoroughly mixing the raw material with the soluble material, it is possible to enhance the uniformity in dispersibility of the cells of the foam.

By selecting a water-soluble material as the soluble material, the extraction and removal of the soluble material can be expected during using the resulting polishing pad 10, too. For this reason, a soluble material having a small extraction and removal rate in the production step can be made subjective to preferred use. Further, a hollow material having a desired particle size can be used in place of the soluble material. By using such a material, it is possible to save labors for performing the extraction and removal of the soluble material in the extraction method during the production step. In order to obtain a hardness, the hollow material is required to have a hardness approximately equivalent to that of the polishing region 12 in the polishing pad 10.

In general, a high density layer called skin layer of several μm is formed on the surface of the polishing pad 10 of the foam obtained by the reaction injection molding method. This skin layer can be easily removed during conditioning of the polishing pad, i.e., preparation (break-in) before use and thus causes no problems particularly in the purpose of the use of polishing pad. A further reference can be made to a method involving the use of a supercritical fluid for the purpose of enhancing the rate of dissolution of inert gas as well as remarkably increasing the gas saturation concentration.

Figure 7:
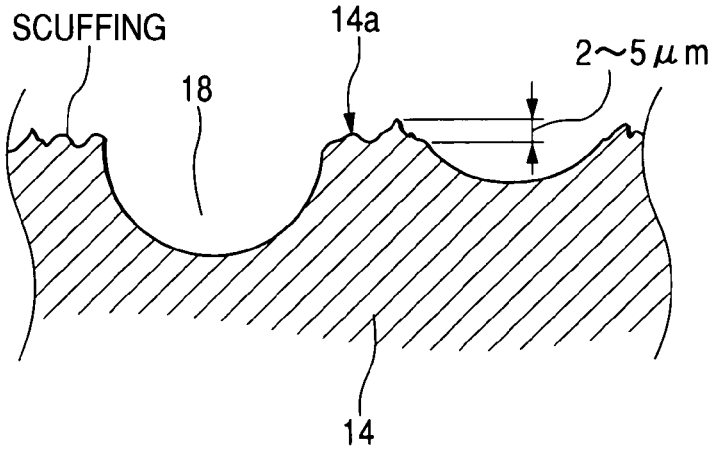
FIG. 7 is a schematic view illustrating minute concave and convex, i.e., the so-called scuffing state on a polishing surface obtained by carrying out a reaction injection molding method.
Figure 8C:
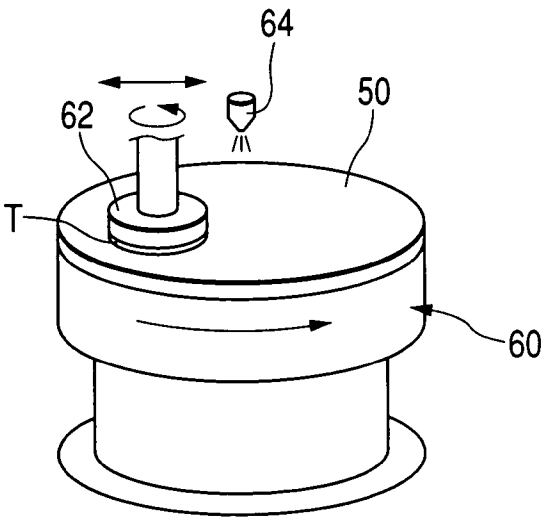
FIGS. 8A, 8B and 8C are explanatory views explaining the steps until polishing an object to be polished such as semi-conductor wafers, using a polishing pad.
Figure 8B:
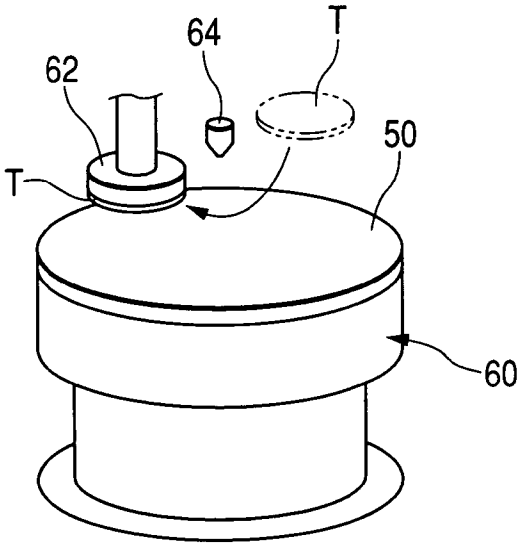
Figure 8A:
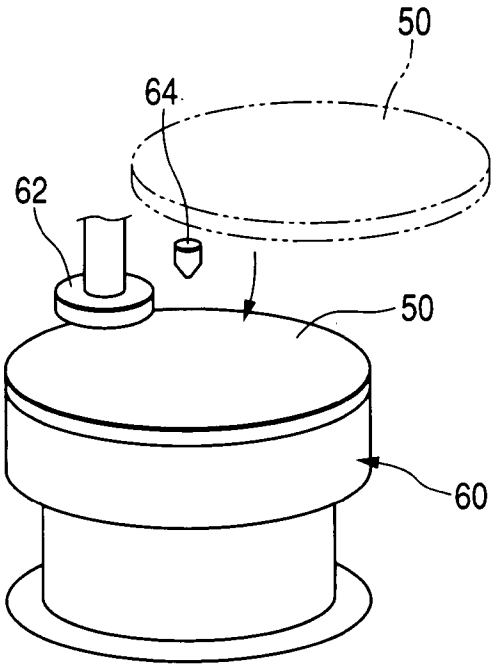
Figure 9:
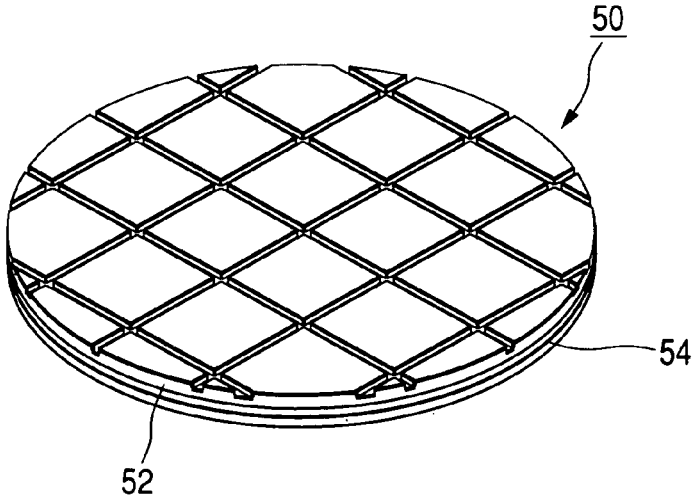
FIG. 9 is a schematic perspective view illustrating a polishing pad of the multilayered structure according to the related art.
Figure 10A:
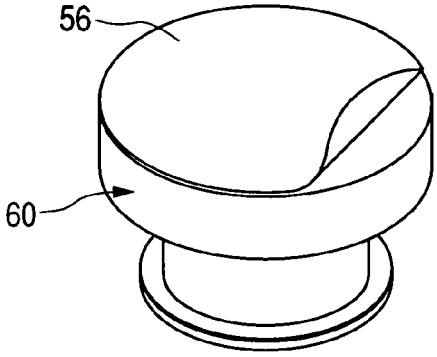
FIGS. 10A, 10B, 10C and 10D are explanatory views explaining a step for sticking and/or fixing a polishing pad of the multilayered structure according to the related art onto a polishing platen.
Figure 10B:
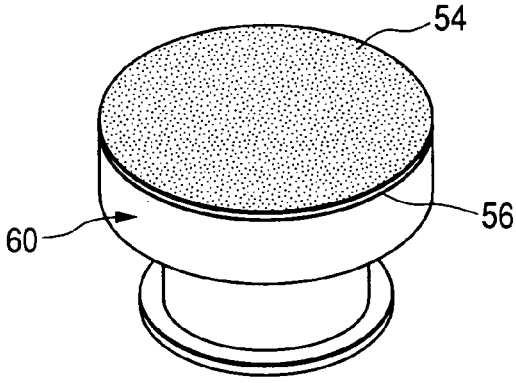
Figure 10C:
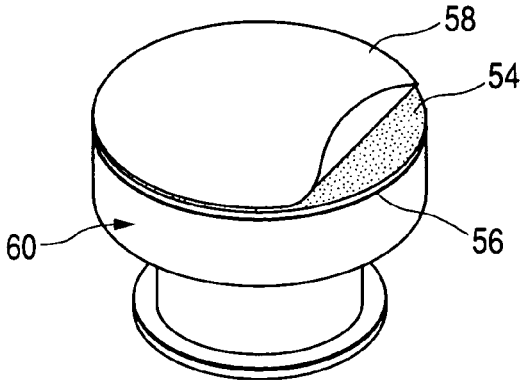
Figure 10D:
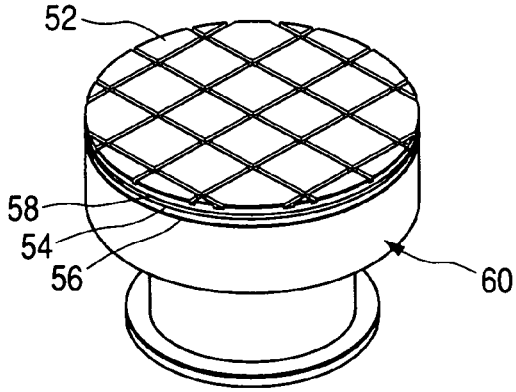

Further, as illustrated in FIG. 7, in the surface state of the polishing pad 10 obtained by the reaction injection molding, a good polishing speed (polishing rate) is attained by minute concave and convex having a unit of several μm, so-called scuffing in addition to the cells 18. In general, this scuffing is largely visualized by the conditioning treatment of the polishing surface 14*a*, which is carried out when the polishing rate becomes worse. However, in the polishing pad 10 to be prepared by the reaction injection molding method according to the invention, since the size of the cells 18 present in the gas-dissolved raw material can be arbitrarily adjusted by the degree of stirring and the pressure during injection, it is possible to suitably control the surface state in which the scuffing has been generated. Specifically, it is desired that minute surface concave and convex of from about 2 μm to 5 μm be present as the scuffing.

In the invention, by using a material having the same density as the material quality and intentionally providing an air gap such as a groove in a part of the region, the structural density (bulk density) is lowered to form the stress reduction region for revealing a good deflection, thereby coping with the step height reduction and the in-plane uniformity. However, as other measures, the same effect is obtained by a method for making it possible to reveal the desired amount of deflection by taking a large size for the thickness of the whole as shown in the experimental examples as described later; and a so-called two-color molding method which can be suitably carried out by the reaction injection molding method, etc. through continuous injection of two materials having different physical properties (here, a high-hardness material to be used as the polishing region and a high-flexibility material to be used in the stress reduction region).

As described previously, in accordance with the polishing pad according to the invention, since the polishing pad is one prepared by integrally molding a polishing region having a hardness capable of revealing excellent step height reduction and a stress reduction region having a deflection capable of revealing excellent in-plane uniformity by the reaction injection molding, a polishing pad capable of revealing good in-plane uniformity was obtained without causing a phenomenon that the height level to be determined by the fixing works against the polishing platen becomes unstable from occurring.

The invention will be further described below with reference to the following Examples and Comparative Examples.

Specifically, by forming a prescribed stress reduction region and changing the amount of deflection, various physical properties required for polishing pads, such as step height reduction and in-plane uniformity due to the difference of the stress reduction region are observed and/or measured. It should not be construed that the polishing pad according to the invention is limited to these Examples.

(Experiment 1)

Re: Relationship Between Density and Amount of Deflection In Stress Reduction Region Pursuant to the aforementioned condition of thickness (total thickness: 3.0 mm, thickness of stress reduction region: 1.0 mm), polishing pads according to Examples 1 and 2 and Comparative Examples 1 and 2 having a density of each of the polishing region and the stress polishing region as shown in Table 1 were produced and measured with respect to the following physical property values. The measurement methods and confirmation methods of the respective physical property values are as follows.

(Evaluation Items and Evaluation Methods)

(1) Physical Properties

A: Density

Measured according to JIS K 6401.

B: Hardness

Measured at a temperature of 22° C. and a relative humidity of 55% using a Shore D hardness meter defined in ASTM D 2240.

C: Amount of Deflection of the Whole

Measured under a condition of a compression rate of 0.1 mm/min based on the method defined in JIS K 6254.

(2) Evaluation of Polishing Characteristics:

As a polishing machine, there was used a CMP device for 8-inch use. Optimum objects to be polished were each polished for every evaluation item under the following conditions to confirm D (step height reduction), E (in-plane uniformity) and F (overall evaluation as a polishing pad obtained therefrom). Here, the step height reduction D was evaluated according to the two-grade criterion (G: good, P: poor). The in-plane uniformity E was evaluated according to the three-grade criterion (G: good, F: slightly poor, P: poor). The overall evaluation F was evaluated according to the three-grade criterion (G: suitable for use; F: usable; P: not usable).

Conditions

Rotary speed of platen and head: 100 r.p.m.

Polishing pressure: 34 kPa

Abrasive: General-purpose $SiO_2$ slurry for oxide film

Flow rate of abrasive: 200 mL/min (Results of Experiment 1)

The results of the various measurement items are shown in Table 1. It has been confirmed from Table 1 that when the amount of deflection of the resulting polishing pad is 15 μm or more, both good step height reduction and in-plane uniformity are revealed. Further, it has been confirmed that when the stress reduction region is 2.0 mm as the upper limit, the necessary density is not more than 0.35 g/cm$^3$.

TABLE 1

| | Various physical property values | | | | Polishing characteristics | | |
|---|---|---|---|---|---|---|---|
| | A Bulk density ($g/cm^3$) | | | C | D | | |
| | Polishing region | Stress reduction region | B D hardness | Amount of deflection (μm) | Step height reduction | E In-plane uniformity | F Overall evaluation |
| Example 1 | 0.73 | 0.15 | 55 | 36 | G | G | G |
| Example 2 | 0.73 | 0.35 | 55 | 15 | G | G | G |
| Comparative Example 1 | 0.73 | 0.40 | 55 | 14 | G | P | P |
| Comparative Example 2 | 0.73 | 0.50 | 55 | 11 | G | P | P |

(Experiment 2)

Re: Relationship Between Thickness and Amount of Deflection in Stress Reduction Region Basically, a conventionally known polishing pad having a multilayered structure (trade name: IC-1400, manufactured by Rodel Nitta Company) was used as a standard, and polishing pads according to Examples 3 to 6, Comparative Examples 3 to 4 and Referential Examples 1 to 3 as shown in the following (Explanation of Examples), (Explanation of Comparative Examples) and (Explanation of Referential Examples) and in Table 2 were produced while setting up the thickness of the whole at 2.50 mm. The resulting respective pads were measured with respect to the aforementioned various physical property values.

EXPLANATION OF EXAMPLES

A material having a Shore D hardness of 55, a bulk density of 0.73 $g/cm^3$ and a thickness of 2.50 mm is used as a polyurethane-based foam, onto which a stress reduction portion having a prescribed depth is formed in the form of a lattice having a groove width of 2 mm and a pitch of 3.2 mm, and which is defined as a stress reduction region.

Example 3

Single-layered polishing pad having a depth of the stress reduction portion (thickness of the stress reduction region) of 0.80 mm and a thickness of the polishing region of 1.70 mm Example 4

Single-layered polishing pad having a depth of the stress reduction portion (thickness of the stress reduction region) of 1.23 mm and a thickness of the polishing region of 1.27 mm Example 5

Single-layered polishing pad having a depth of the stress reduction portion (thickness of the stress reduction region) of 1.73 mm and a thickness of the polishing region of 0.77 mm Example 6

Single-layered polishing pad having a depth of the stress reduction portion (thickness of the stress reduction region) of 0.50 mm and a thickness of the polishing region of 2.00 mm

EXPLANATION OF COMPARATIVE EXAMPLES

Comparative Example 3

Single-layered polishing pad made of a material prepared only by slicing the 2.50 mm-thick polyurethane-based foam (Shore D hardness: 55, bulk density: 0.73 $g/cm^3$) into a thickness of 1.27 mm Comparative Example 4

Single-layered polishing pad made of a material prepared only by slicing the 2.50 mm-thick polyurethane-based foam (Shore D hardness: 55, bulk density: 0.73 $g/cm^3$) into a thickness of 1.80 mm

EXPLANATION OF REFERENTIAL EXAMPLES

Referential Example 1

Multilayered polishing pad: a trade name: IC-1400, manufactured by Rodel Nitta Company (total thickness: 2.50 mm)

Referential Example 2

Polishing pad using a polyurethane-based foam having a thickness of 4.00 mm, in which a polishing region is constituted over the whole of the thickness without providing a stress reduction region Referential Example 3

Polishing pad using a polyurethane-based foam having a thickness of 5.00 mm, in which a polishing region is constituted over the whole of the thickness without providing a stress reduction region Results of Experiment 2

The results of the various measurement items are shown in Table 2. It has been confirmed from Table 2 that when the amount of deflection of the resulting polishing pad is 15 μm or more, both good step height reduction and in-plane uniformity are revealed. Further, it has been confirmed that in the case of the conditions according to this Experiment, i.e., the bulk density of the stress reduction region is 0.15 $g/cm^3$, in attaining the amount of deflection of 15 μm, the thickness of the stress reduction layer is −0.80 mm or more. Moreover, it has been confirmed that even in the polishing pad made of only a polyurethane-based foam having a bulk density of 0.73 $g/cm^3$ and a sufficient hardness as the polishing region, when its thickness is 4.00 mm or more, it is possible to attain the amount of deflection of 15 μm.

TABLE 2

| | Thickness (mm) | | | Various physical property values: A Bulk density ($g/cm^3$) | | B | C | Polishing characteristics: D | E | F |
|---|---|---|---|---|---|---|---|---|---|---|
| | The whole | Polishing region | Stress reduction region | Polishing region | Stress reduction region | D hardness | Amount of deflection (μm) | Step height reduction | In-plane uniformity | Overall evaluation |
| Example 3 | 2.50 | 1.70 | 0.80 | 0.73 | 0.15 | 55 | 15 | G | G | G |
| Example 4 | 2.50 | 1.27 | 1.23 | 0.73 | 0.15 | 55 | 24 | G | G | G |
| Example 5 | 2.50 | 0.77 | 1.73 | 0.73 | 0.15 | 55 | 33 | G | G | G |
| Example 6 | 2.50 | 2.00 | 0.50 | 0.73 | 0.15 | 55 | 13 | G | G | G |
| Comparative Example 3 | 1.27 | 1.27 | | 0.73 | | 55 | 5 | G | P | P |
| Comparative Example 4 | 1.80 | 1.80 | | 0.73 | | 55 | 7 | G | P | P |
| Referential Example 1 (Multilayered product) | 2.50 | 1.27 | 1.23 | 0.73 | 0.48 | 55 | 23 | G | G | G |
| Referential Example 2 | 4.00 | 4.00 | | 0.73 | | 55 | 16 | G | F to G | F to G |
| Referential Example 3 | 5.00 | 5.00 | | 0.73 | | 55 | 20 | G | F to G | F to G |

While the invention has been described in detail and with reference to specific embodiments thereof, it will be apparent to one skilled in the art that various changes and modifications can be made therein without departing from the spirit and scope thereof.

The entire contents of Japanese patent application filed Jul. 11, 2002 (Patent Application No. 2002-203122) are hereby incorporated by reference.

What is claimed is:

1. A polishing pad comprising a polyurethane-based foam in a desired shape having uniform cells, which is obtained by using a gas-dissolved raw material that comprises an inert gas dissolved under pressure in a mixture of a main raw material from which a polyurethane or a polyurea is synthesized and subsidiary raw materials and molding the gas-dissolved raw material by a reaction injection molding method, wherein the polishing pad includes a polishing region having a polishing surface suitable for polishing semi-conductor materials and having a Shore D hardness, as defined according to ASTM D2240, in the range of from 40 to 80, and a stress reduction region which is present in the side opposing to the polishing surface and which is provided with a stress adjusting portion of a desired pattern and has an amount of deflection, as applied with a load of 0.05 MPa, of 10 μm or more.

2. The polishing pad according to claim 1, wherein the stress reduction region has a bulk density in the range of from 0.15 $g/cm^3$ to 0.35 $g/cm^3$.

3. The polishing pad according to claim 1, wherein the cells have an average size in the range of from 1 μm to 50 μm.

4. The polishing pad according to claim 1, wherein the surface of the polishing surface, the surface in the side opposing to the polishing surface, or both surfaces of the polishing surface are subjected to physical cutting, thereby forming a discharge groove, a stress adjusting portion, or both.

5. The polishing pad according to claim 1, wherein the shape of the stress reduction region is a concentric circle, spiral or radial form having the center of the polishing pad as a base point.

* * * * *